US006937922B2

(12) United States Patent
Shimizu

(10) Patent No.: US 6,937,922 B2
(45) Date of Patent: Aug. 30, 2005

(54) CONVEYER-BELT SUSHI CONTROL SYSTEM CAPABLE OF CONTROLLING AMOUNT OF SUSHI

(75) Inventor: Yoshio Shimizu, Toyonaka (JP)

(73) Assignee: Akindo Sushiro Co., Ltd., Osaka-Fu (JP)

( * ) Notice: Subject to any disclaimer, the term of this patent is extended or adjusted under 35 U.S.C. 154(b) by 332 days.

(21) Appl. No.: 10/002,123

(22) Filed: Dec. 5, 2001

(65) Prior Publication Data

US 2002/0108506 A1 Aug. 15, 2002

(30) Foreign Application Priority Data

Feb. 13, 2001 (JP) ..... 2001-035356

(51) Int. Cl.[7] ..... G06F 7/00
(52) U.S. Cl. ..... 700/230; 198/341.03
(58) Field of Search ..... 700/230, 228, 700/225, 216, 226; 198/341.03, 341.06, 341.07

(56) References Cited

U.S. PATENT DOCUMENTS

| | | | | |
|---|---|---|---|---|
| 4,349,086 A | * | 9/1982 | Yamada | 186/49 |
| 4,609,092 A | * | 9/1986 | Takai | 198/367 |
| 6,260,694 B1 | * | 7/2001 | Sasahara | 198/860.4 |
| 6,465,038 B2 | * | 10/2002 | Aoki | 426/643 |
| 6,467,580 B2 | * | 10/2002 | Shin | 186/49 |
| 6,527,106 B2 | * | 3/2003 | Tanabe et al. | 198/853 |

FOREIGN PATENT DOCUMENTS

| | | | |
|---|---|---|---|
| JP | 62-107773 U | | 7/1987 |
| JP | 6-314285 | | 11/1994 |
| JP | 8-414 | | 1/1996 |
| JP | 8-80244 | | 3/1996 |
| JP | 09-044753 A | | 2/1997 |
| JP | 410234553 A | * | 9/1998 |
| JP | 11-046958 A | | 2/1999 |
| JP | 11-103996 | | 4/1999 |
| JP | 411250356 A | * | 9/1999 |
| JP | 3065074 B1 | | 5/2000 |
| JP | 2000-135155 | | 5/2000 |
| JP | 3103921 B2 | | 9/2000 |
| JP | 2000-255749 | | 9/2000 |
| JP | 2002-065442 A | | 3/2002 |

* cited by examiner

*Primary Examiner*—Richard Ridley
(74) *Attorney, Agent, or Firm*—Birch, Stewart, Kolasch & Birch, LLP

(57) ABSTRACT

A conveyer-belt sushi control system, in which an amount of sushi distributed by a conveyer belt can accurately be counted, is provided as follows. A plurality of menu stands are mounted on a conveyer-belt table. A menu stand is followed by a plate on which sushi of a kind described on the menu stand is arranged. When the menu stand passes near a sensor, the sensor detects information output from the menu stand (e.g. electric wave for specifying a kind of sushi passing by subsequent to the menu stand). The sensor counts the number of passing-by plates until it detects the next menu stand, enabling counting of the amount of sushi per kind.

12 Claims, 18 Drawing Sheets

FIELD

| SENSOR NUMBER | PRODUCT NAME | COUNTER |
|---|---|---|
| 0001 | TUNA | 5 |
| 0002 | SQUID | 3 |
| 0004 | SALMON | 2 |

FIG. 15

| SUSHI PLATE ID | KIND | TIME ELAPSED AFTER FIRST IDENTIFICATION |
|---|---|---|
| 0001 | TUNA | 1 MINUTE AND 30 SECONDS |
| 0002 | (UNDETECTED) | ——— |
| 0003 | TUNA | 2 MINUTES AND 12 SECONDS |
| 0004 | SALMON | 32 SECONDS |
| 0005 | SHRIMP | 2 MINUTES AND 48 SECONDS |
| | | |
| ⋮ | ⋮ | ⋮ |
| 0507 | UNDETECTED FOR A LONG TIME (LOST ?) | ——— |
| | | |
| | | |

FIG. 17

VARIABLE RECORD 1

| IDENTIFICATION NUMBER | PRODUCT NUMBER | PRODUCT NAME | COUNTER | AMOUNT OF PREPARATION | AMOUNT OF CONSUMPTION |
|---|---|---|---|---|---|
| 0001 | 0001 | TUNA | 4 | 60 | 45 |
| 0002 | 0002 | YOUNG YELLOWTAIL | 3 | 80 | 38 |
| 0003 | 0001 | TUNA | 5 | 30 | 16 |
| 0004 | 0003 | SQUID | 5 | 20 | 13 |
| 0005 | 0004 | SALMON | 2 | 15 | 12 |
| 0006 | 0001 | TUNA | 3 | 40 | 40 |
| 0007 | 0004 | SALMON | 5 | 50 | 34 |
| ⋮ | ⋮ | ⋮ | ⋮ | ⋮ | ⋮ |

FIG. 18

VARIABLE RECORD 2

| PRODUCT NUMBER | PRODUCT NAME | ACCUMULATION OF PREPARATION | ACCUMULATION OF CONSUMPTION | AMOUNT PREPARED THIS TIME | AMOUNT CONSUMED THIS TIME |
|---|---|---|---|---|---|
| 0001 | TUNA | 110 | 91 | 20 | 10 |
| 0002 | YOUNG YELLOWTAIL | 60 | 18 | 20 | 20 |
| 0003 | SQUID | 15 | 8 | 5 | 5 |
| 0004 | SALMON | 50 | 20 | 15 | 14 |
| | | | | | |

FIG. 20

| SUSHI PLATE ID | KIND | TIME ELAPSED AFTER FIRST IDENTIFICATION | WIN FLAG |
|---|---|---|---|
| 0001 | TUNA | 1 MINUTE AND 30 SECONDS | |
| 0002 | (UNDETECTED) | ——— | |
| 0003 | TUNA | 2 MINUTES AND 12 SECONDS | ○ |
| 0004 | SALMON | 32 SECONDS | |
| 0005 | SHRIMP | 2 MINUTES AND 48 SECONDS | |
| | | | |
| ⋮ | ⋮ | ⋮ | |
| 0507 | UNDETECTED FOR A LONG TIME (LOST ?) | ——— | |
| | | | |
| | | | |

CONVEYER-BELT SUSHI CONTROL SYSTEM CAPABLE OF CONTROLLING AMOUNT OF SUSHI

BACKGROUND OF THE INVENTION

1. Field of the Invention

The present invention relates to a conveyer-belt sushi control system, and particularly, to a conveyer-belt sushi control system controlling the amount of sushi distributed by a conveyer belt.

2. Description of the Background Art

Conventionally, an enterprise managing and running several conveyer-belt sushi restaurants is known. Each of the restaurants is provided with a conveyer-belt table having a conveyer belt for sushi, and supplies customers with sushi that are conveyed by the conveyer belt.

Moreover, a mark is applied to a plate to control the plate. For example, a plate that has been left on the conveyer-belt table for a predetermined time is eliminated.

However, in conventional conveyer-belt sushi restaurants, the amount of sushi cannot be grasped, resulting in high probability of excessive preparation or shortage of sushi.

Furthermore, in the conventional art, individual control of products conveyed by the conveyer belt is impossible. It is assumed that, for example, there are a plate on which sushi is arranged and that on which cake is arranged. In such a case, as sushi loses its freshness in a shorter time, the time period from preparation to elimination of the plate of sushi is desirably set shorter than that of the plate of cake. However, in the conventional art, though plates can be controlled, products on the plates cannot be identified. Therefore, it is impossible to individually determine the time period before elimination for each product.

SUMMARY OF THE INVENTION

The present invention is made to solve the problems as described above, and the first object of the present invention is to provide a conveyer-belt sushi control system that can accurately count the amount of sushi distributed by a conveyer belt.

The second object of the present invention is to provide a conveyer-belt sushi control system that can count the amount of sushi, distributed by a conveyer belt, per kind of sushi.

The third object of the present invention is to provide a conveyer-belt sushi control system that can control a sushi plate and a kind of sushi placed thereon.

In order to achieve the objects described above, according to an aspect of the present invention, a conveyer-belt sushi control system controlling sushi distributed by a conveyer belt includes a detection portion for detecting an identifier distributed together with sushi, and a counting portion for commencing counting of an amount of sushi distributed by the conveyer belt in response to a detection output of the detection portion.

According to another aspect of the present invention, in a conveyer-belt sushi control system controlling sushi distributed by a conveyer belt, the sushi is arranged on a plate, and the plate is provided with information for identifying the plate. The system includes a detection portion for detecting an identifier distributed together with sushi; a determination portion for determining a kind of sushi arranged on the plate, based on the identifier detected by the detection portion; and a storage portion for storing a determination result of the determination portion.

According to a further aspect of the present invention, in a conveyer-belt control system controlling sushi distributed by a conveyer belt, the sushi is mounted on a plate, and the plate is provided with information for identifying the plate. The system includes a storage portion for storing a win flag to be associated with information for identifying the plate.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 15 shows information recorded in a RAM according to the second embodiment;

FIGS. 17 and 18 show variable records 1 and 2;

FIG. 20 shows tabulated data used in the fifth embodiment;

DESCRIPTION OF THE PREFERRED EMBODIMENTS

First Embodiment

Figure 1:
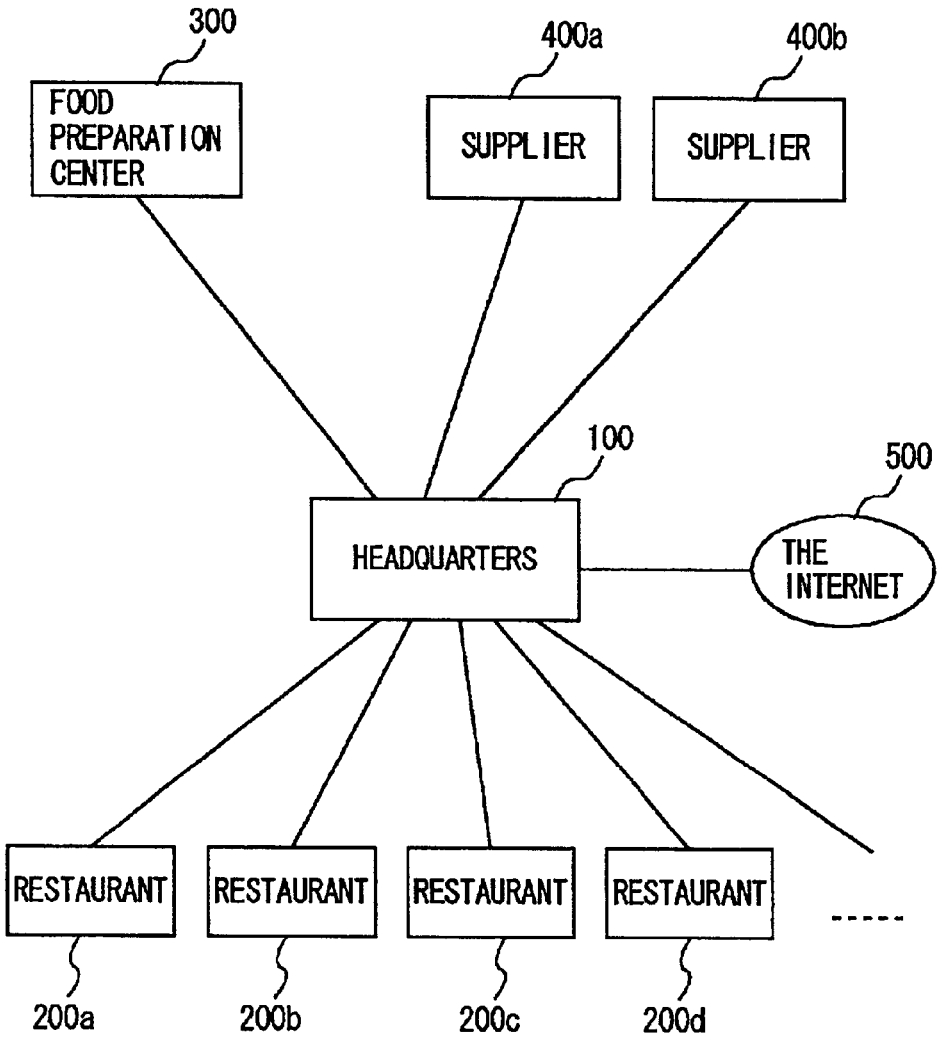
FIG. 1 shows a configuration of a running system of conveyer-belt sushi restaurants according to an embodiment of the present invention.

Referring to FIG. 1, a conveyer-belt sushi restaurant running system includes a headquarters 100 controlling various information such as ordering of products, sales, attendance of employees, and other information in each restaurant; a plurality of restaurants 200*a* to 200*d* providing customers with sushi; a food preparation center 300 processing foodstuff required for preparation of sushi; and suppliers 400*a*, 400*b* supplying foodstuff required for preparation of sushi.

Headquarters 100, each of restaurants 200*a* to 200*d*, food preparation center 300 and suppliers 400*a*, 400*b* are interconnected via a communication line (a public circuit, a private line, the Internet or the like may be used therefor).

Moreover, headquarters 100 is connected to the Internet 500.

Each of restaurants 200*a* to 200*d* is provided with a terminal for entering the number and brackets of customers, and a sensor detecting the kind and amount of sushi on a conveyer belt. The information obtained by the terminal and sensor are transmitted to headquarters 100 in real time. This allows headquarters 100 to grasp the condition of each restaurant.

Moreover, in each restaurant, the total amount of sushi provided in one day is counted for each kind, and orders are automatically sent to suppliers 400*a*, 400*b* based on the counted amount, via a communication means such as a telephone, a facsimile or an electronic mail.

Sushi left on the conveyer belt in each restaurant for a predetermined time is automatically disposed of by an ejection device, which is formed by an actuator operated in accordance with a signal from a computer. It is noted that the amount of such sushi disposed of is also automatically counted so as to be taken into consideration when an order quantity (a purchasing quantity) is determined.

Thus, the order quantity can be reduced for foodstuff used for sushi of a kind that was unpopular and hence a large amount thereof were disposed of. Also, the amount of such a kind of sushi to be supplied in the restaurant can be reduced.

Figure 2:
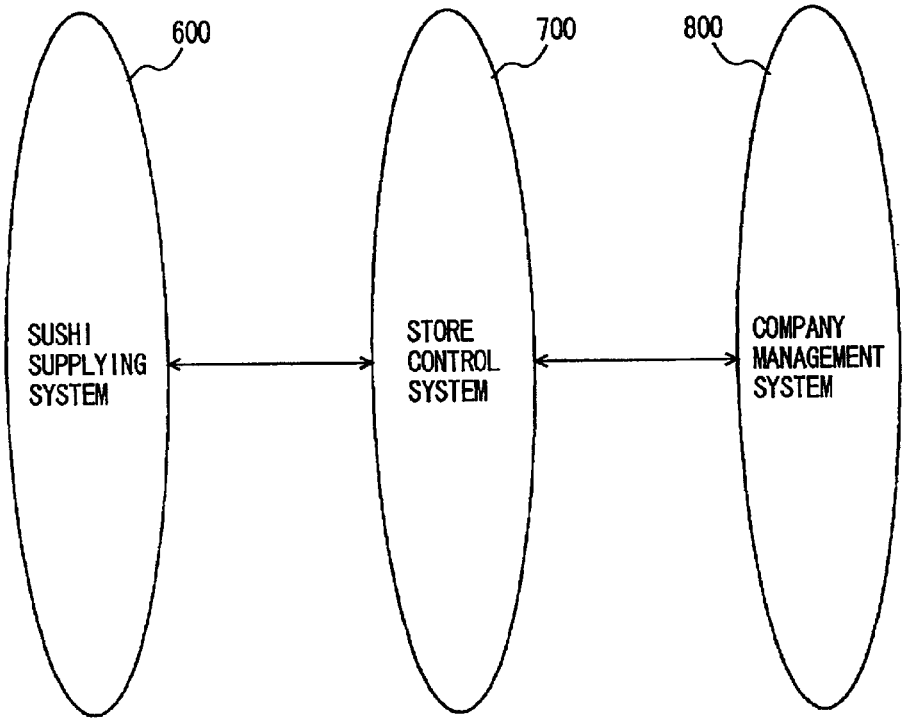
FIG. 2 shows a configuration of a running system of a conveyer-belt sushi restaurant.

FIG. 2 shows the configuration of a running system of a conveyer-belt sushi restaurant according to the present embodiment.

Referring to FIG. 2, the conveyer-belt sushi restaurant running system includes a sushi supplying system 600, a store control system 700, and a company management system 800.

Sushi supplying system 600 for collecting various information of products and customers in each restaurant, and providing various information required for management of the restaurant. The techniques described in Japanese Patent Laying-Open No. 11-103996 and Japanese Patent Laying-Open No. 2000-135155 may be used for the sushi supplying system.

Store control system 700 is a system that intensively controls various information of each restaurant such as ordering of products, sales, and attendance of employees, to easily and uniformly control each restaurant.

Company management system 800 is a system that collects and grasps everyday business information for each restaurant, and intensively controls various information generated in the company, to grasp a management condition in real time. Company management system 800 also controls financial and accounting information obtained by processing the information that have been put together accordingly.

Sushi supplying system 600 is installed in each of restaurants 200*a* to 200*d*, whereas store control system 700 and company management system 800 are installed in headquarters 100.

Details of each system will be described below.

(1) Sushi supplying system 600

Sushi supplying system 600 has an object of giving instructions for combination of topping and an optimal value of the amount of sushi to be supplied to customers. Another object of sushi supplying system 600 is to automatically eliminate, from a conveyer-belt table, sushi left for a predetermined time after being supplied.

The effects derived by sushi supplying system 600 are as follows:

(a) supply of sushi that fits customers'preferences (b) supply and elimination of sushi with emphasis on hygiene control (c) alleviation of burden to employees in each restaurant (d) grasp of customer brackets from data of e.g. the number and age brackets of customers, entered by an employee using a terminal (e) counting and automatic grasp of fast-selling sushi (f) reduction of losses (g) automatic ordering of foodstuff required for preparation of sushi (h) automatic collection of restaurant information (the total amount of sushi supplied, kinds of topping, amount of sushi per topping, amount of sushi disposed of, kinds of sushi disposed of, total number of customers, number of groups of customers, number of customers per group, number of adults/children, sales figures per customer, and so forth)

It is noted that sushi supplying system 600 includes, as a hardware configuration, an in-store personal computer (PC)-local area network (LAN) system, a CCD color camera, and various sensors.

(2) Store Control System 700

An object of store control system 700 is to collect, by on-line, various information and data transmitted from each restaurant, in order to automate, speed-up and simplify processes. Moreover, computerization of all works would facilitate control of new restaurants that may be open in the future. Furthermore, computerization allows cost reduction and management rationalization.

By store control system 700, processes performed in each restaurant and in the headquarters can also be automated.

Store control system 700 is constituted as follows.

Sushi supplying system 600 and a terminal dedicated to data entry are installed in each restaurant, and sushi supplying system 600 and the terminal are connected to a PC-LAN in headquarters 100 via a line such as a public circuit.

Various data indicating e.g. ordering, checking of incoming items, inventory taking, sales figures, cash, employee attendance, and expenses are entered from each restaurant by the dedicated terminal, and are transmitted to store control system 700. Moreover, data in sushi supplying system 600, such as data of customer brackets, the amount of sushi disposed of and the amount of sushi supplied, are also transmitted from each restaurant to store control system 700.

In store control system 700, received data are classified, and are subjected to various processes (such as order accepting and placing, handling of accounts payable, inventory taking, and handling of sales and cash in hand), depending on the type of the received data.

(3) Company Management System 800

Company management system 800 is a system introduced for the purposes of achieving a small head office, rapidly determining managerial matters, and accurately and rapidly grasping management conditions.

Introduction of company management system 800 achieves effects such as rationalization of management, cost reduction, sharing of information and clarification of management.

Company management system 800 conducts the following works.

Figure 3:
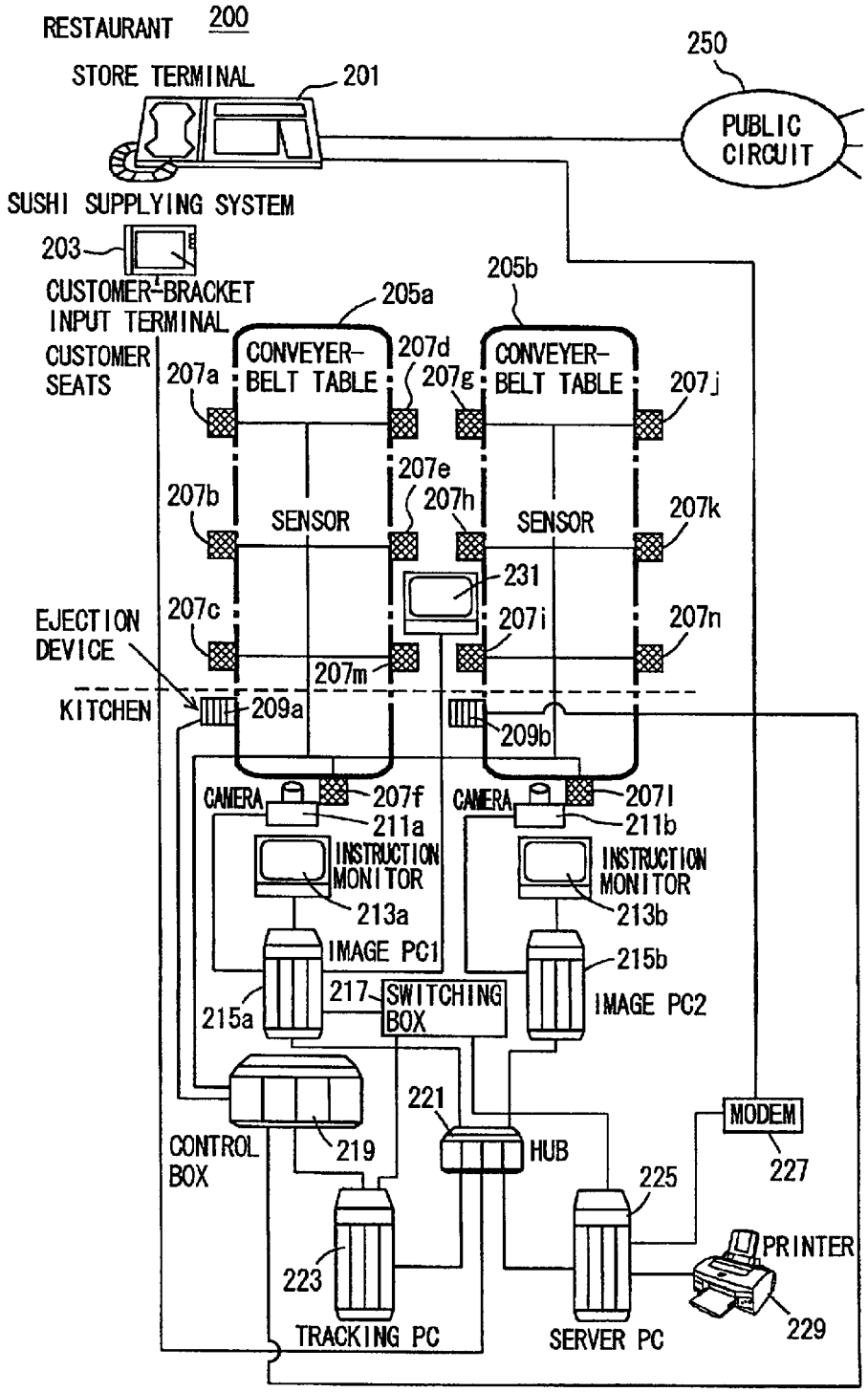
FIG. 3 specifically shows a sushi supplying system.

(a) automatic processing of each data by the PC-LAN system in the headquarters (b) payroll calculation process (c) accounting process (d) monthly closing (e) daily and monthly profit control (f) daily, weekly and monthly store control (g) cost control FIG. 3 shows the specific configuration of the sushi supplying system installed in each of restaurants 200*a* to 200*d* in FIG. 1.

Referring to FIG. 3, the sushi supplying system includes a store terminal 201; a customer-bracket input terminal 203; conveyer-belt tables 205*a*, 205*b*; sensors 207*a* to 207*n* detecting passage of sushi moving on the conveyer-belt tables; ejection devices which serve as disposal means 209*a*, 209*b* ejecting sushi left on the tables for predetermined time; COD cameras 211*a*, 211*b* shooting the moving sushi from above; a display monitor 231 displaying information such as advertisement for customers; instruction monitors 213*a*, 213*b* instructing employees in the kitchen to prepare certain kind and amount of sushi; personal computers for images 215*a*, 215*b* for processing and displaying images; a switch box 217 switching signals; a control box 219 controlling the entire system; a hub 221 connecting a plurality of computers; a tracking personal computer 23 performing a tracking process on sushi on the conveyer-belt tables; a server personal computer 225 storing data; a printer 229 outputting data; and a modem 227 used for connection with a public circuit.

Store terminal 201 is connected to a public circuit 250.

Sushi that has been left on the tables for a certain period of time after preparation is disposed of by ejection devices 209*a*, 209*b*. Then, the kind and amount of sushi disposed of are counted and input into server PC 225.

Based on the number of customers and the kind (whether adults or children) of customers that were entered by customer-bracket input terminal 203, and considering the kind and amount of sushi currently on the conveyer-belt tables 205*a*, 205*b*, tracking PC 223 obtains appropriate kinds and amount of sushi to be on conveyer-belt tables 205*a*, 205*b*, and displays instruction of sushi preparation (kinds and amount) onto instruction monitors 213*a*, 213*b* accordingly. Thus, in each restaurant, sushi of kinds and amount that fit the needs of customers can be provided, eliminating guesswork for employees.

Figure 4:
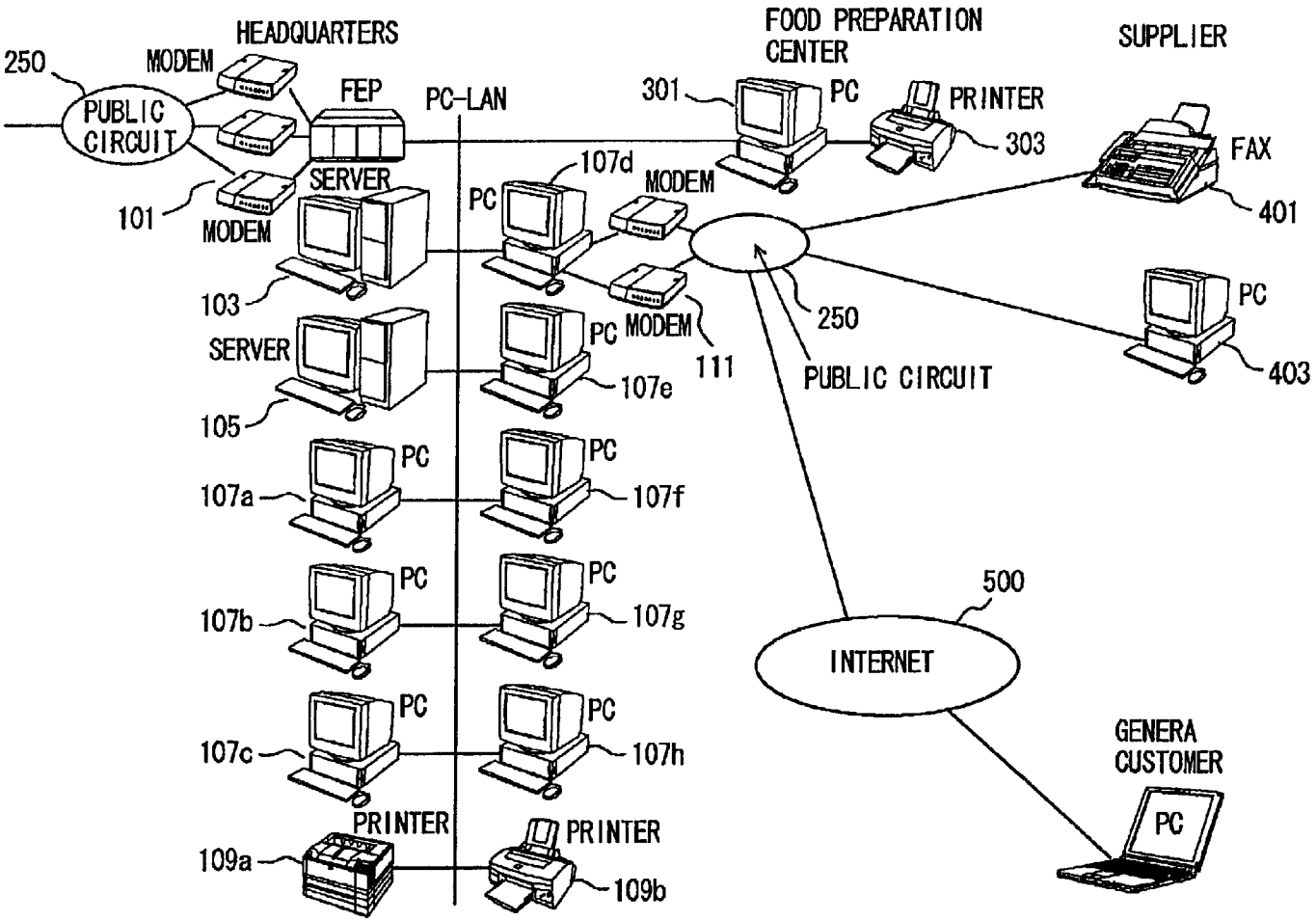
FIG. 4 shows a configuration of a system installed in a headquarters, a food preparation center and each supplier.

FIG. 4 shows the configuration of a system provided in headquarters 100, food preparation center 300 and each of suppliers 400*a*, 400*b* shown in FIG. 1. The system in the headquarters shown in FIG. 4 corresponds to the hardware of store control system 700 and company management system 800 in FIG. 2.

The system in the headquarters includes a plurality of modems 101 connected to public circuit 250; servers 103, 105; personal computers 107*a* to 107*h*; printers 109*a*, 109*b*; and a modem 111.

The system in the food preparation center includes a personal computer 301 and a printer 303.

The system in the supplier includes a facsimile device 401 and a personal computer 403.

Various devices in the headquarters and food preparation center are connected by LAN. Moreover, these devices are connected to the system in the supplier via public circuit 250.

Furthermore, the system in the headquarters is connected to the Internet 500. Thus, a general customer can have an access to the system in the headquarters via the Internet 500 for accessing data stored in servers 103, 105 (advertisement or questionnaire data of a conveyer-belt sushi restaurant), and also for ordering sushi.

Figure 5:
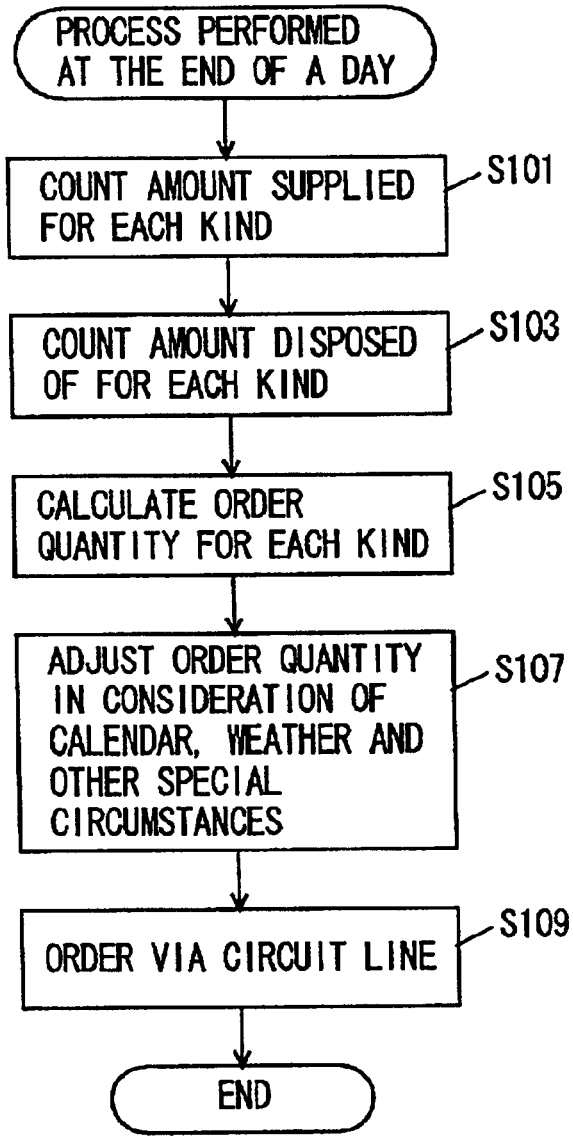
FIG. 5 is a flowchart showing a process performed in a sushi supplying system of each restaurant after business hours of a day.

FIG. 5 is a flow chart showing a process performed in the sushi supplying system in each restaurant after business hours of a day.

Referring to FIG. 5, at step S101, the amount of sushi supplied in the day is counted per kind. Next, at step S103, the amount of sushi disposed of is counted per kind.

At step S105, an order quantity of foodstuff required for preparation of sushi is automatically calculated based on the amount supplied and the amount disposed of.

At step S107, the order quantity is adjusted in consideration of a calendar, weather, and other special circumstances.

At step S109, an order is automatically sent via the line.

Thus, in the present system, calculation of the appropriate order quantity and automatic ordering can be performed in consideration of the amount of sushi supplied, the amount of sushi disposed of, the calendar, the weather and other circumstances. Moreover, by the sushi supplying system, sushi of preferred kinds can be supplied by an appropriate amount onto the conveyer-belt tables according to the customer brackets.

Furthermore, various information in each restaurant can be intensively controlled in the headquarters.

This allows, for example, employees in each restaurant to run the restaurant, without special knowledge or know-how in supplying and purchasing of sushi. Therefore, introduction of the present system enables simple and rationalized running of a conveyer-belt sushi restaurant.

Figure 6:
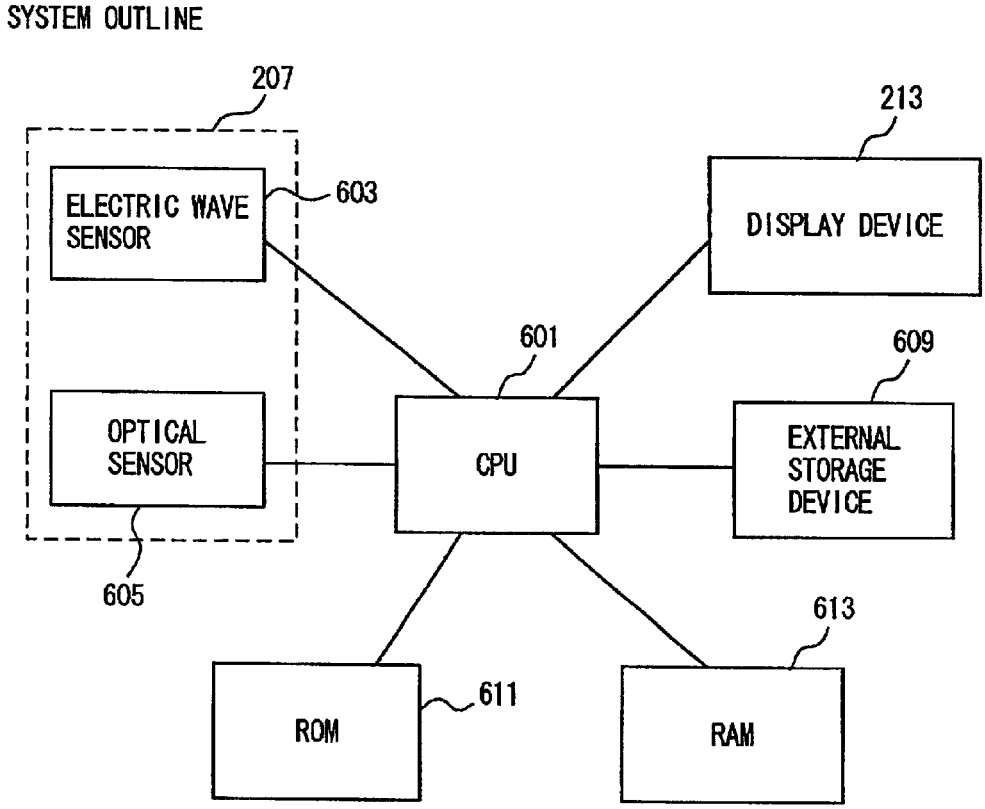
FIG. 6 shows a configuration of a device for counting the amount of sushi, included in the running system of conveyer-belt sushi restaurants in FIG. 1.

FIG. 6 is a block diagram showing the configuration of a sushi counting device included in the conveyer-belt sushi restaurant running system shown in FIG. 1.

Referring to FIG. 6, the sushi counting device includes a CPU 601 controlling the entire device; a ROM storing a program or the like as shown in the flow chart, which will be described below; a RAM 613 recording the amount of sushi per kind; a sensor 207 provided near a conveyer-belt table; a display device 213 instructing an employee on sushi preparation and displaying the amount of sushi; and an external storage device 609.

It is noted that sensor 207 represents one of sensors 207*a* to 207*n* in FIG. 3, and display device 213 represents either one of instruction monitors 213*a*, 213*b* shown in FIG. 3.

Sensor 207 includes an electric wave sensor 603 detecting electric wave output from a menu stand conveyed by the conveyer-belt table, and an optical sensor 605 detecting passage of a sushi plate.

Figure 7:
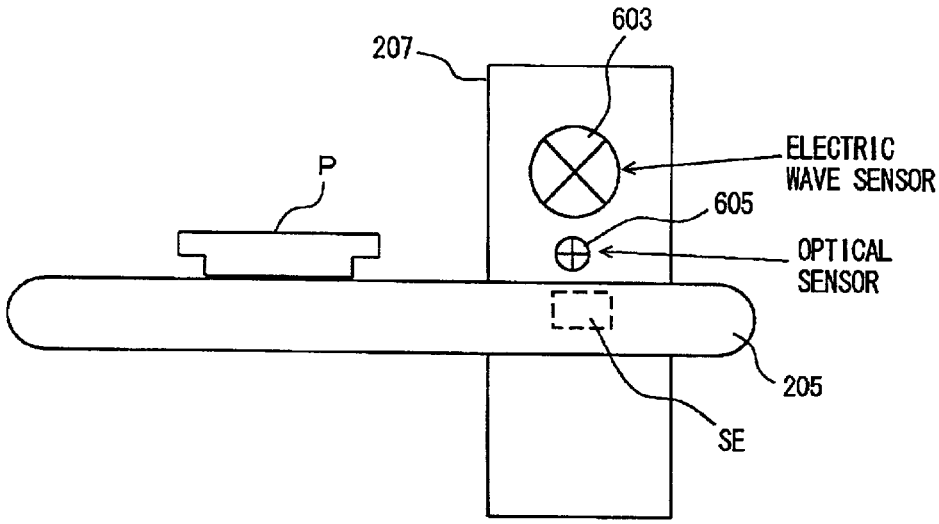
FIG. 7 is a side view showing the configuration of a sensor 207.

FIG. 7 is a side view showing an installment example of sensor 207. Referring to FIG. 7, sensor 207 is provided near a conveyer-belt table 205. As a plate P on which sushi is arranged passes by optical sensor 605, plate P blocks the light entering into optical sensor 605. Thus, passage of one plate is detected. Moreover, the number of passing sushi plates can be obtained by counting the number of times that the light is blocked.

Figure 8:
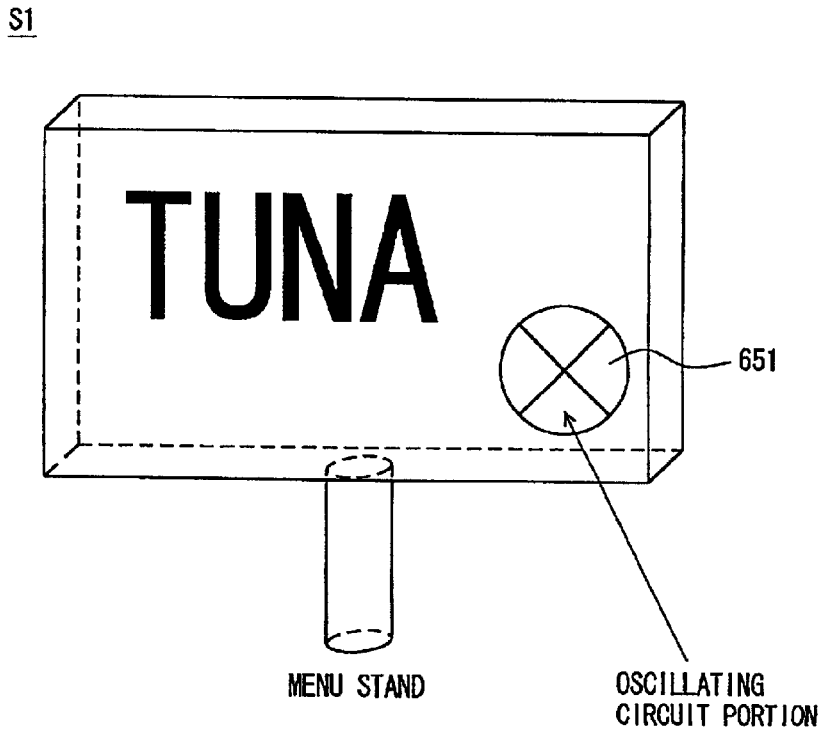
FIG. 8 is a perspective view showing the configuration of a menu stand.

FIG. 8 is a perspective view showing the configuration of a menu stand. On the menu stand, a character or graphic symbol (or photograph), indicating a kind of sushi, is shown for a person to view. Moreover, an oscillating circuit portion 651 (a type of indicator) is provided on the menu stand.

Oscillating circuit portion 651 outputs a signal (e.g. a sensor number such as "0001" or "0002") that is unique to the menu stand. The menu stand is also distributed together with a sushi plate by conveyer-belt table 205. As the menu stand passes by electric wave sensor 603 provided in sensor 207 (see FIG. 7), electric wave sensor 603 catches a signal output from oscillating circuit portion 651. Thus, the kind of menu stand that has passed the portion of sensor 207 is determined.

A plurality of menu stands are mounted on conveyer-belt table 205, and a plate on which sushi of the kind shown on each menu stand is arranged in a section defined by a space between two menu stands. A signal output by oscillating circuit portion 651 of each menu stand is set to correspond to the kind of sushi, so that the amount of that kind of sushi existing on the conveyer-belt table 205 can be counted by optical sensor 605. Thus, the amount of sushi on conveyer-belt table 205 can be grasped for each kind in real time.

A more specific example will be described below.

Figure 9:
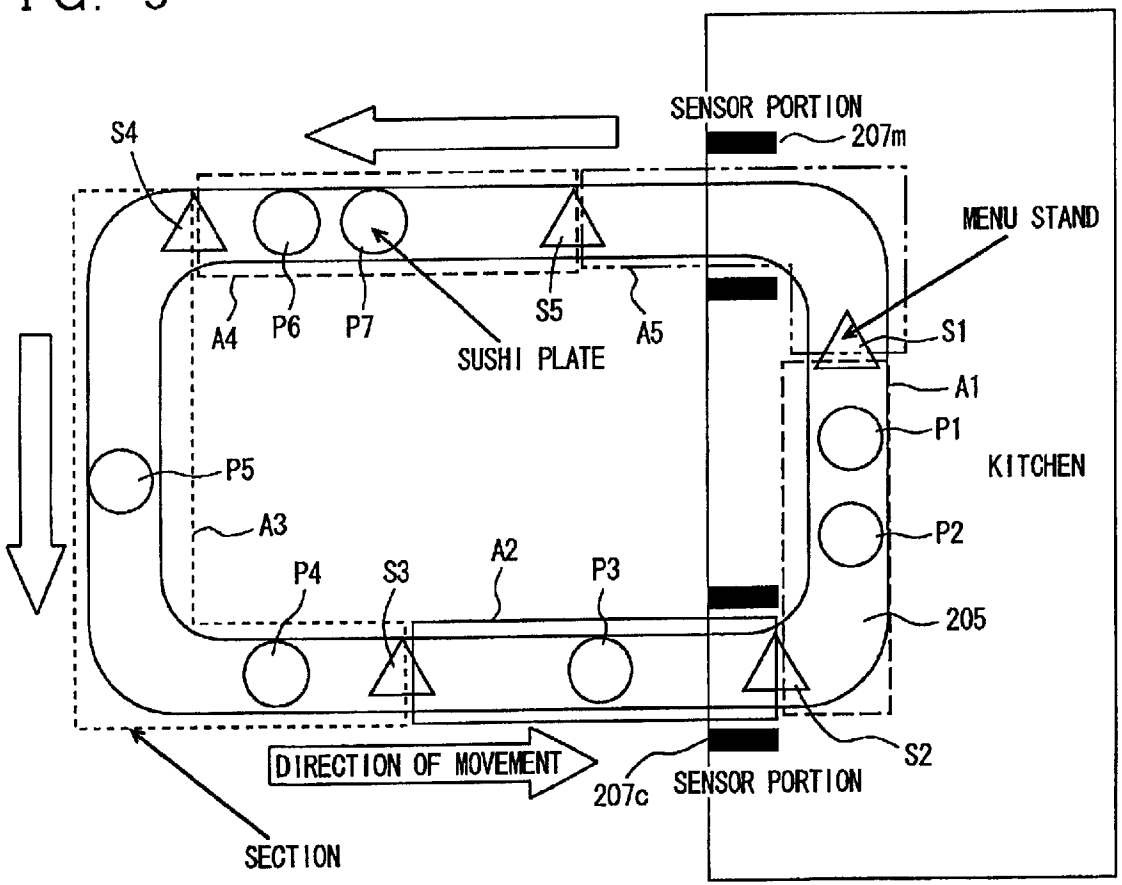
FIG. 9 is a plan view showing the schematic configuration of a conveyer-belt table.

FIG. 9 shows a schematic view of conveyer-belt table 205 when viewed from above. It is assumed that sushi plates P1 to P7 and menu stands S1 to S5 move in the counterclockwise direction as indicated by outlined arrows. Here, a space between a menu stand and the next menu stand defines one section. In FIG. 9, menu stand S1 defines a section A1, and menu stand S2 defines a section A2. Likewise, menu stands S3 to S5 define sections A3 to A5 respectively. A section is uniquely defined by menu stands and the direction of a conveyer-belt rotation.

For example, as shown in FIG. 8, a character, a graphic symbol, a photo or the like indicating "tuna" is shown on menu stand S1, and oscillating circuit portion 651 provided on the menu stand outputs a signal indicating the sensor number "0001." Plates P1, P2 on which sushi topped with tuna are arranged are placed within section A1 defined by menu stand S1, so that the number of plates having sushi topped with tuna (two plates P1, P2 in this example) can be counted by sensor 207.

More specifically, when sensor 207 detects passage of menu stand S1, a counter commences counting of the number of plates, and continues the counting until passage of menu stand S2 is subsequently detected by sensor 207.

Figures 10, 11:
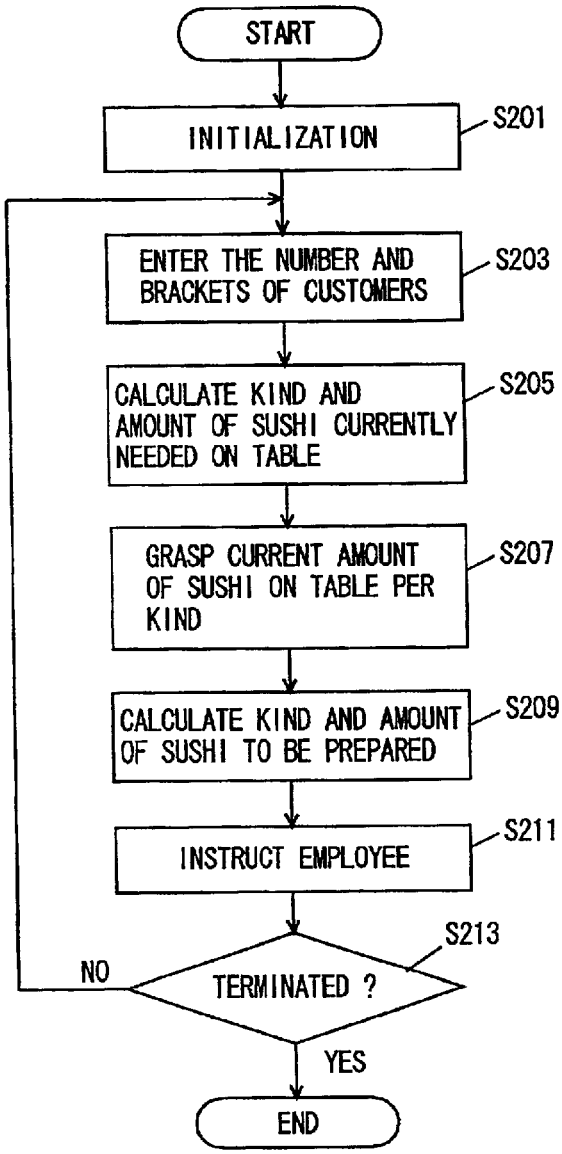
FIG. 10 shows tabulated data recorded in a RAM according to the first embodiment.
FIG. 11 is a flow chart showing a process of instructing an employee.

FIG. 10 shows tabulated data recorded in a RAM shown in FIG. 6. Sensor numbers 0001, 0002 and 0004 are set to correspond to tuna, squid and salmon respectively, and sensors are used to determine, in real time, how many sushi pieces of those kinds there are on the table.

FIG. 11 is a flow chart showing a process of instructing an employee, using the sushi counting device.

The process in the flow chart is executed by CPU 601 shown in FIG. 6. First, initialization is performed at step S201.

At step S203, the number and brackets of customers are entered using customer-bracket input terminal 203. At step S205, the kinds and amount of sushi currently needed on the table are calculated based on the brackets and number of customers. The calculation may be performed in accordance with mathematical expressions or may be performed based on tabulated data.

At step S207, the amount of sushi currently on the conveyer-belt table is determined per kind by the sushi counting device.

At step S209, the kind and amount of sushi to be prepared is calculated based on the kind and amount of sushi grasped and those of sushi needed. At step S211, an instruction is given to an employee by display device 213.

At step S213, steps from S203 downward are repeated until the business of the day in the restaurant is terminated.

Figure 12:
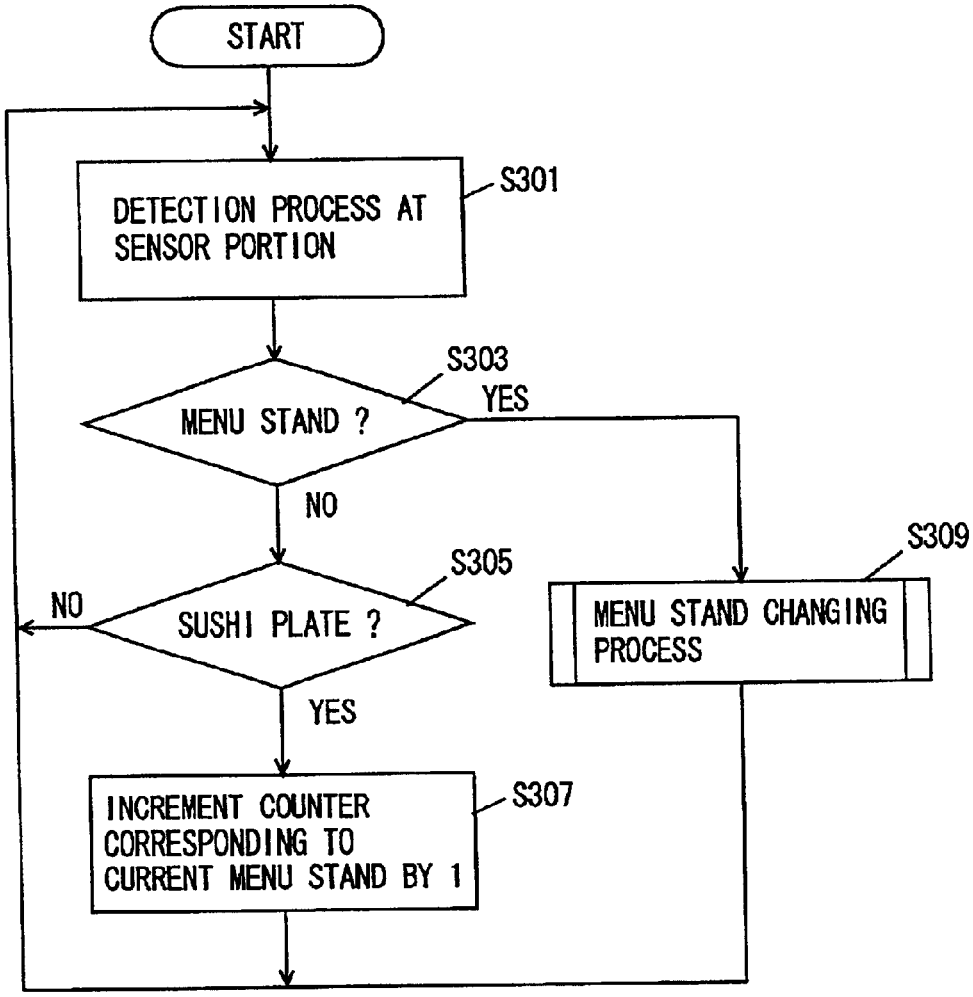
FIG. 12 is a flow chart showing a process of counting sushi plates.

FIG. 12 is a flow chart showing a process of displaying an reduced amount of sushi onto display device 213.

Referring to FIG. 12, at step S301, a detection process is performed by a sensor. At step S303, it is determined whether or not a menu stand has passed by the sensor, and if NO, it is determined, at step S305, whether or not a sushi plate has passed by.

If YES at step S305, a counter corresponding to the current menu stand is incremented by 1 at step S307, and then the process goes back to step S301.

When no passage of sushi plates is detected at step S305, the process goes back to step S301.

If YES is selected at step S303, the process of changing the menu stand is performed at step S309.

Figure 13:
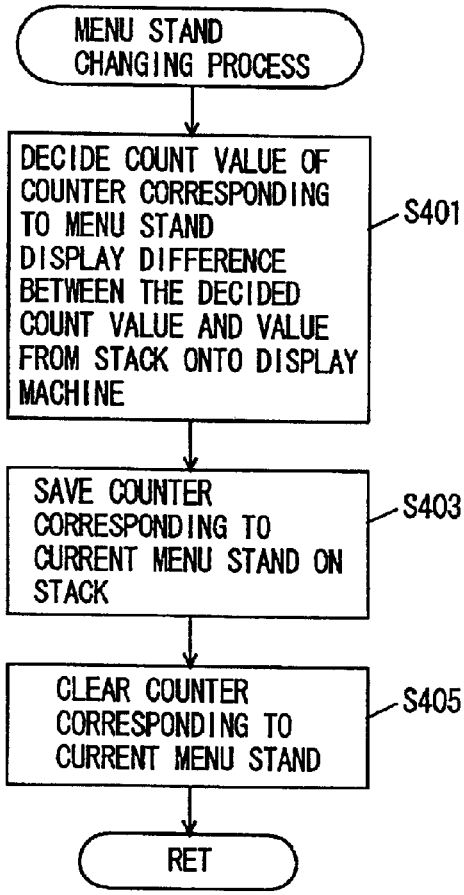
FIG. 13 is a flow chart showing a process of changing a menu stand (S309) in FIG. 12.

FIG. 13 is a flow chart showing details of the menu stand changing process (S309) in FIG. 12.

Referring to FIG. 13, a count value of a counter corresponding to a menu stand is decided at step S401. Then, data is read from a stack in which a count value of the counter corresponding to the menu stand is previously stored, and a difference between the counter values is obtained to be displayed onto display device 213.

At step S403, the counter corresponding to the current menu stand is saved on the stack. At step S405, the counter corresponding to the current menu stand is cleared to be back to the main routine.

As described above, in the present embodiment, the amount of sushi can easily be counted per kind by detecting a menu stand and a plate, which facilitates instructions for an employee on sushi preparation and ordering of foodstuff required for preparation of sushi, based on the counted amount of sushi.

It is noted that, though a menu stand is used in the present embodiment as a way of detecting the kind of sushi, any alternative means that can show information for identifying the kind of sushi to the outside (e.g. a mark such as a bar code, color, a pattern, a signal or the like) may also be used.

Second Embodiment

A conveyer-belt sushi restaurant running system according to the second embodiment of the present invention will be described below for portions different from those shown in the first embodiment.

Figure 14:
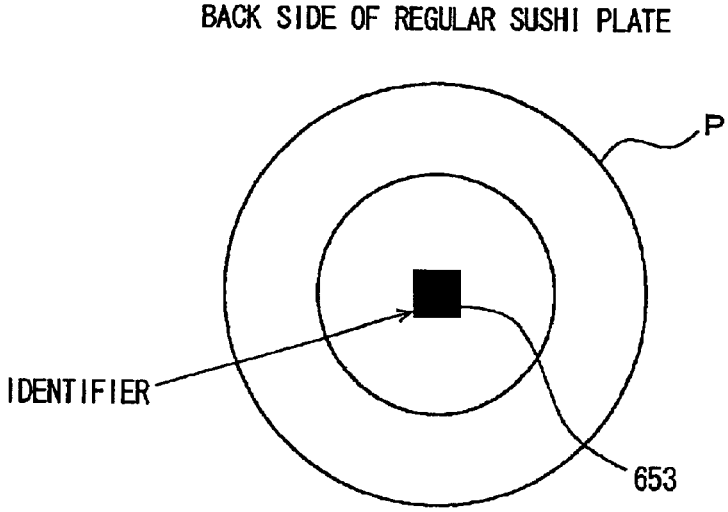
FIG. 14 is a bottom plan view of a sushi plate used in a system according to the second embodiment.

FIG. 14 is a bottom plan view of a sushi plate used in the conveyer-belt sushi restaurant running system according to the second embodiment. In the second embodiment, an identifier 653 (such as one-or two-dimensional bar code or chip that holds information) for identifying each plate is attached to each sushi plate. Information on identifier 653 is read by a sensor SE shown in FIG. 7.

By using such an identifier 653 for identifying each plate, an ID (identification) can be allocated to each and every sushi plate. Then, the kind of sushi arranged on a plate is specified by a menu stand or the like, as described in the first embodiment, allowing individual control of sushi to determine what kind of sushi is arranged on each plate.

Moreover, the location of each plate can also be controlled by coordinates.

FIG. 15 shows data recorded in RAM 613 according to the present embodiment. As shown in FIG. 15, the kind of sushi arranged on a sushi plate is recorded per ID of the plate. Moreover, the time elapsed from the first detection of the sushi plate by sensor SE, which indicates a time elapsed after preparation of the sushi, is recorded. This allows disposal of sushi that has left on the conveyer-belt table for a predetermined time after preparation.

Furthermore, the time period from preparation to disposal of products may be varied depending on the kind of product arranged on a sushi plate (the kind of sushi such as tuna, salmon, shrimp, and the kind of dessert such as cake, pudding), to more appropriately control freshness of products.

If a sushi plate has not been detected by sensor SE for a predetermined period of time, it is assumed that the sushi has been consumed. Further, if a sushi plate with an ID that has not been detected for a long time (e.g. on the order of several days), it is regarded as broken or lost.

It is noted that, also in the second embodiment, the amount of sushi on the conveyer-belt table can be obtained per kind.

Conventionally, entering information of sushi as a single item (information concerning the kind and amount of sushi prepared) was very troublesome, so that it was difficult to individually control each sushi plate. According to the present embodiment, however, information concerning sushi is automatically entered per plate, resulting in effects of labor saving and easy individual control of sushi plates.

Third Embodiment

A conveyer-belt sushi restaurant running system according to the third embodiment will be described below for the points different from the first embodiment.

Figure 16:
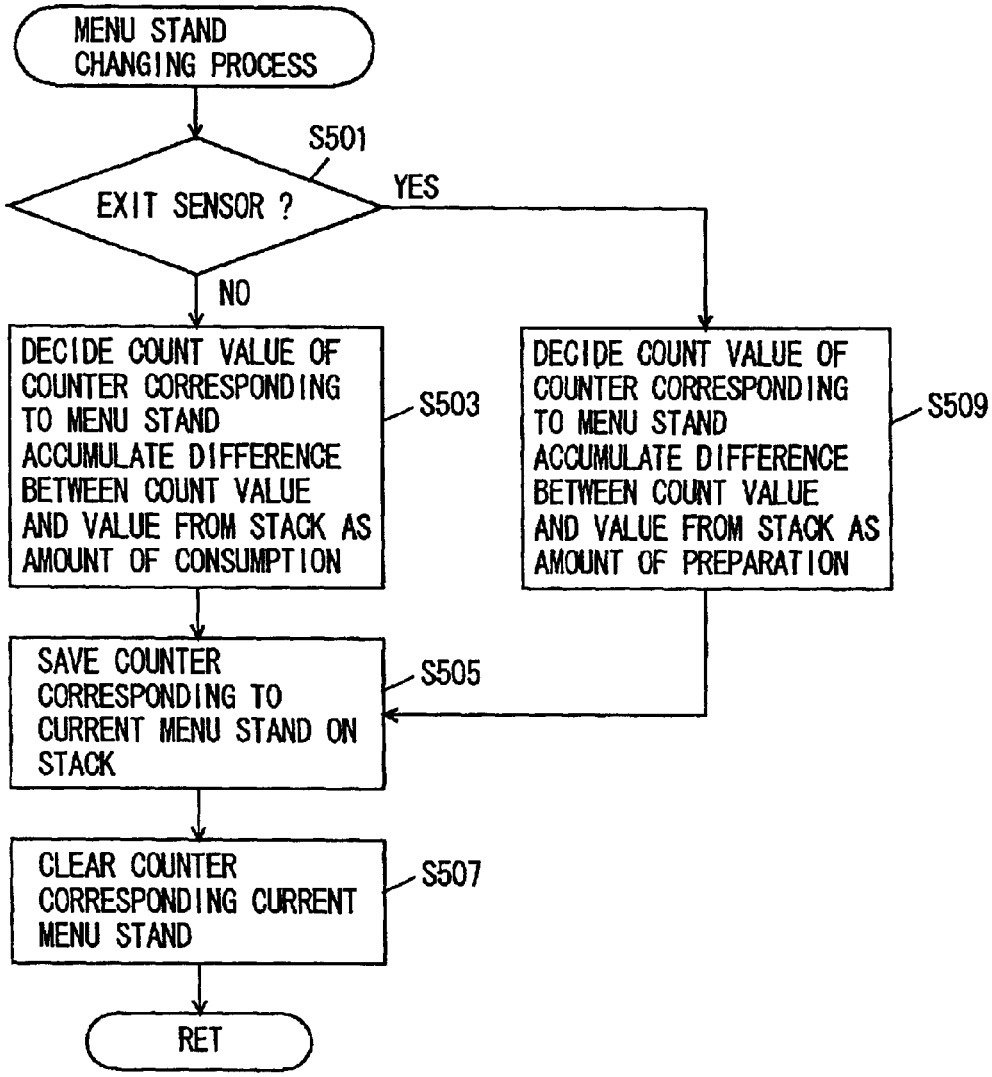
FIG. 16 is a flow chart showing a process executed in the third embodiment.

In the third embodiment, a process of changing menu stands shown in a flow chart of FIG. 16 is executed in place of the menu stand changing process shown in FIG. 13. Specifically, in the present embodiment, sushi going out of the kitchen shown in FIG. 9 is controlled by sensor 207*m*, whereas sushi coming back to the kitchen is controlled by sensor 207*c*. This allows control of the amount of sushi prepared (prepared amount) by kind and also control of the amount of sushi consumed (used amount) by kind.

Referring to FIG. 16, it is determined, at step S501, whether or not the process by sensor 207 provided at the exit of the kitchen is performed. If NO, the amount of sushi coming back to the kitchen is to be calculated. Thus, at step S503, a count value of a counter corresponding to a menu stand is decided, and the difference between the decided count value and the value saved in a stack is accumulated as an amount of consumption.

At step S505, a counter corresponding to a current menu stand is saved on the stack, and the counter corresponding to the current menu stand is cleared at step S507.

As for the process performed by the sensor provided at the exit of the kitchen, at step S509, the count value of the counter corresponding to the menu stand is decided and the difference between the count value and the value saved in the stack is accumulated, before moving on to step S505.

In the present embodiment, sensors provided at the exit and entrance of the kitchen are used for accumulating and calculating the amount consumed and the amount prepared. This allows control of information concerning sushi in more detail.

Fourth Embodiment

A conveyer-belt sushi restaurant running system according to the fourth embodiment of the present invention will be described below for the points different from the first embodiment.

For a longer conveyer-belt table, the need arises in that a plurality of menu stands of the same kind are placed on the conveyer-belt table to distribute the same kind of sushi divided in different groups. According to the present embodiment, the kind and amount of sushi prepared and consumed can be controlled even in such a case.

Specifically, a variable record 1 shown in FIG. 17 and a variable record 2 shown in FIG. 18 are recorded in the RAM.

Referring to FIG. 17, in addition to identification numbers respectively attached to menu stands as in the case with the first to third embodiments, product numbers are also recorded in the present embodiment to be associated with the respective identification numbers. Here, the product number of "0001" indicates that the product (the kind of sushi) is tuna, and the product number of "0002" indicates that the product is young yellowtail. A counter is provided per identification number and counts the number of sushi plates within a section defined by menu stands, as in the case with the first embodiment. Furthermore, as described in the third embodiment, the amount of sushi prepared and consumed in the section is recorded into variable record 1 to be associated with each identification number.

Moreover, by summing the contents of variable record 1 per product, variable record 2 shown in FIG. 18 is created. In variable record 2, accumulation of prepared amount of a product and accumulation of used (consumed) amount of the product are recorded for each product number. In addition to accumulation, the amount of the product prepared and that consumed this time are also recorded.

Figure 19:
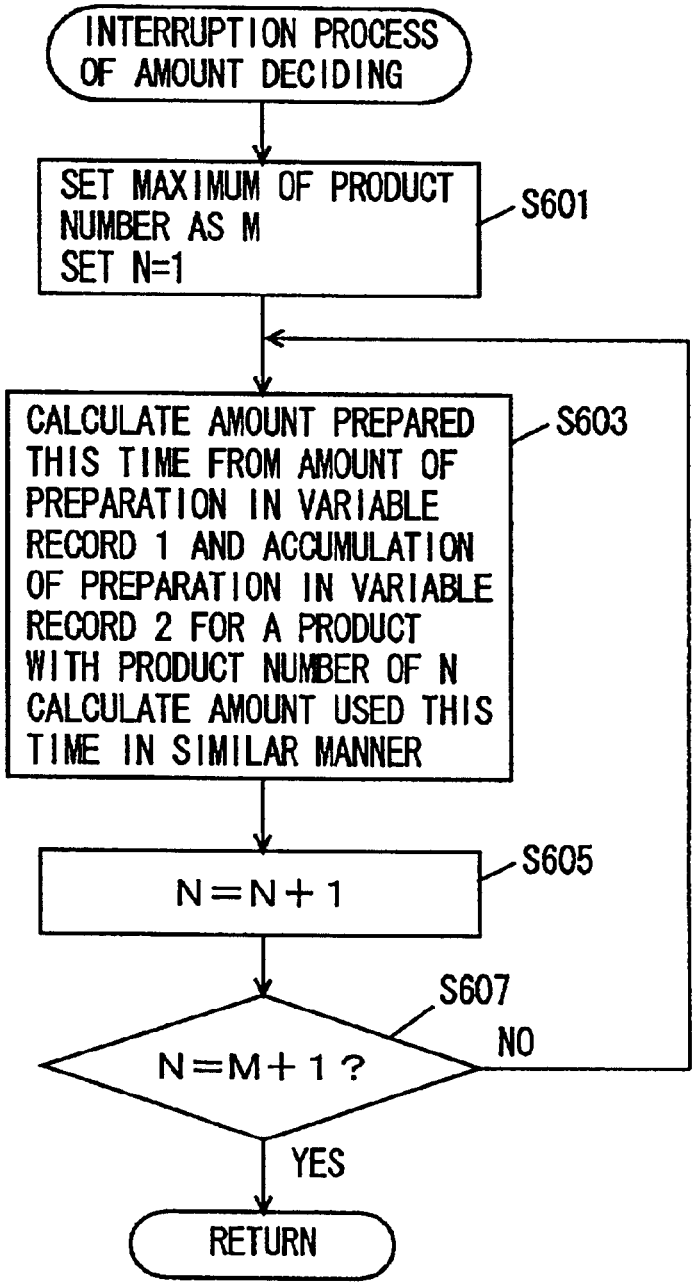
FIG. 19 is a flow chart showing a process executed in the fourth embodiment.

FIG. 19 is a flow chart showing an interruption process of amount-deciding that is executed in the system according to the present embodiment. The interruption process is executed every time the conveyer-belt table takes a round.

At step S601, the maximum product number is set to be M, and "1" is assigned to N.

At step S603, the amount of sushi prepared this time is calculated for the product of the product number N, based on the "amount prepared" in variable record 1 and "accumulation of amount prepared" in variable record 2. The amount of sushi consumed this time is also calculated in a similar manner.

At step S605, the value of N is incremented by 1.

At step S607, it is determined whether or not N is M+1, and if YES, the current routine is terminated, whereas if NO, the process goes back to step S603.

It is noted that, though the number of sensors may be at least one in the first and second embodiments and at least two (the entrance and exit of the kitchen) in the third and fourth embodiments, sensors 207*a* to 207*n* may be installed in a plurality of positions as shown in FIG. 3 to detect the kind and amount of sushi, for obtaining data in more detail.

Furthermore, a number of menu stands may be arranged on the conveyer-belt table as in the fourth embodiment so as to place a number of identifiers included in the menu stands on the conveyer-belt table. This enables effective adjustment of coordinate displacement, when e.g. a manner of controlling plates on the conveyer-belt table in a virtual space is used.

Fifth Embodiment

According to the fifth embodiment, tabulated data shown in FIG. 20 is used in place of the data shown in FIG. 15.

Referring to FIG. 20, the table includes a column in which a "win flag" is recorded at a section corresponding to each sushi plate ID.

Figure 21:
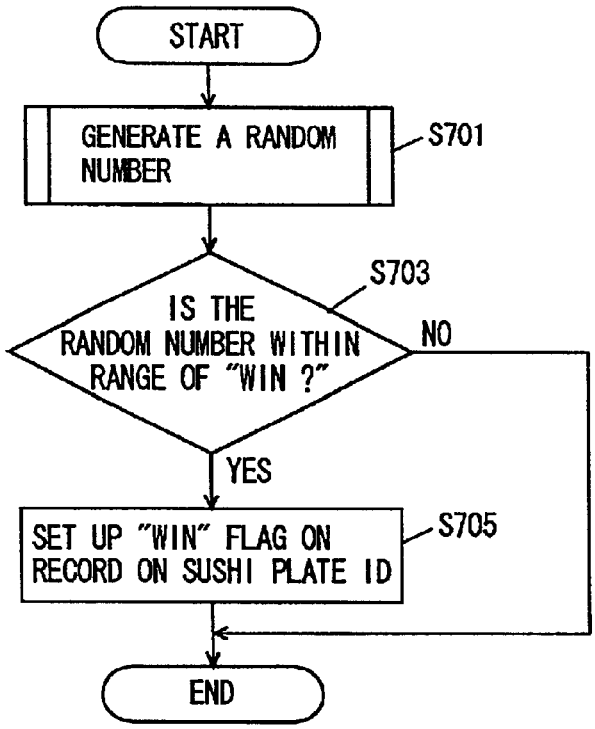
FIG. 21 is a flow chart showing a process of setting a win flag.

FIG. 21 is a flow chart showing a process of setting the win flag.

The process in the flow chart is executed when the identifier of a sushi plate is first detected by sensor SE.

At step S701, a random number (e.g. within the range between 0 and 1) is generated. At step S703, it is determined whether or not the random number is within the range of a winning number (e.g. in the range of 0 to 0.05), and if YES, a win flag (indicated by circle in FIG. 20) is recorded corresponding to the ID of the sushi plate.

Figure 22:
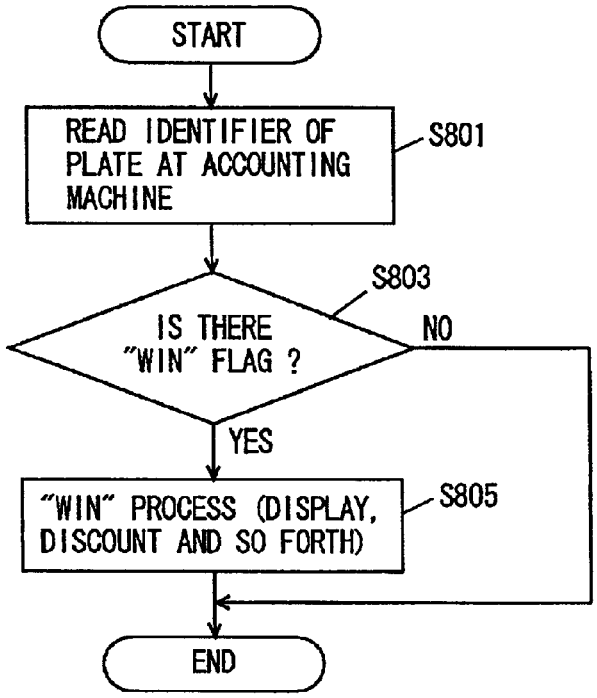
FIG. 22 is a flow chart showing a process of detecting a win flag.

FIG. 22 is a flow chart showing the process of detecting the win flag.

After or during a meal, at step S801, an accounting machine (whether of a fixed type or of a portable type) reads the ID of a sushi plate taken by a customer. The accounting machine accesses the data shown in FIG. 20 to determine whether or not the win flag is recorded corresponding to the ID of the sushi plate (S803). If it is recorded, a "win" process is performed (S805).

The "win" process here means a process of e.g. displaying the fact that there is a winner, outputting a sound, and offering a discount service or the like to the customer who won. Furthermore, in the "win" process, a gift may be given to the customer.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A conveyer-belt sushi control system controlling sushi distributed by a conveyer belt comprising:

a detection means for detecting an identifier distributed together with sushi; and a counting means fort commencing counting of an amount of sushi distributed by said conveyer belt in response to a detection output of said detection means; wherein said counting means calculates an amount of sushi prepared and an amount of sushi consumed by counting an amount of sushi going out of a kitchen and an amount of sushi coming back to the kitchen;

said identifier is attached to a menu stand indicating a kind of sushi to a person; and said menu stand is carried by said conveyer belt together with sushi.

2. A conveyer-belt sushi control system controlling sushi distributed by a conveyer belt comprising:

a detection means for detecting an identifier distributed together with sushi; and a counting means for commencing counting of an amount of sushi distributed by said conveyer belt in response to a detection output of said detection means; wherein said counting means includes a first counting means counting an amount of sushi per identifier, and a second counting means counting an amount of sushi per kind of sushi, based on a counted result of said first counting means; wherein said identifier is attached to a menu stand indicating a kind of sushi to a person; and said menu stand is carried by said conveyer belt together with sushi.

3. A conveyer-belt sushi control system, controlling sushi distributed by a conveyer belt, said sushi being arranged on a plate, said plate being provide with information for identifying said plate, said system comprising:

a detection means for detecting an identifier distributed together with sushi;

a determination means or determining a kind of sushi arranged on said plate, based on the identifier detected by said detection means; and a storage means for storing a determination result of said determination means, to be associated with said information for identifying said plate; wherein said identifier is attached to a menu stand indicating a kind of sushi to a person; and said menu stand is carried by said conveyer belt together with sushi.

4. The conveyer-belt sushi control system according to claim 3, wherein said identifier includes information indicating a kind of sushi distributed subsequent to said identifier.

5. The conveyer-belt sushi control system according to claim 3, comprising a storage means for storing a time period elapsed after preparation of a product, to be associated with said information for identifying said plate.

6. The conveyer-belt sushi control system according to claim 5, further comprising a disposal means for disposing of a product when a predetermined time has elapsed after preparation of said product.

7. The conveyer-belt sushi control system according to claim 6, wherein said predetermined time is changed depending on a kind of a product.

8. A conveyer-belt sushi control system, controlling sushi distributed a conveyer belt, said sushi being arranged on a plate, said plate being provide with information for identifying said plate, said system comprising:

a detection means for detecting an identifier distributed together with sushi;

a determination means for determining a kind of sushi arranged on said plate, based on the identifier detected by said detection means; and a storage means for storing a determination result of said determination means, to be associated with said information for identifying said plate, including a storage means for storing a win flag to be associated with said information for identifying said plate.

9. A conveyer-belt sushi control system controlling sushi distributed by a conveyer belt said sushi being mounted on a plate, said plate being provide with information for identifying said plate, said system comprising:

a storage means for storing a win flag to be associated with said information for identifying said plate.

10. The conveyer-belt sushi control system according to claim 9, said information for identifying said plate is read and a win flag corresponding to said plate is examined, to determine whether or not there is a winner.

11. The conveyer-belt sushi control system according to claim 2, further comprising a third counting means for counting an amount of sushi prepared, an amount of sushi consumed and an amount of products disposed.

12. The conveyer-belt sushi control system according to claim 6, further comprising a third counting means for counting an amount of products disposed.

* * * * *